United States Patent [19]

Gierla

[11] 4,088,317

[45] May 9, 1978

[54] PORTABLE TENNIS COURT

[75] Inventor: Joyce Gierla, Edison, N.J.

[73] Assignee: Lawrence Peska Associates, Inc., New York, N.Y. ; a part interest

[21] Appl. No.: 647,080

[22] Filed: Jan. 7, 1976

[51] Int. Cl.[2] ..... A63C 19/06; A63B 61/00

[52] U.S. Cl. ..... 273/31; 273/29 B; 272/3; 242/74

[58] Field of Search ..... 273/26 A, 27, 29 B, 273/29 BB, 29 BC, 30, 31, 95 R, 95 H; 272/3; 242/61, 62, 74

[56] References Cited

U.S. PATENT DOCUMENTS

| | | | |
|---|---|---|---|
| 335,579 | 2/1886 | Gutzloe | 273/31 |
| 1,076,920 | 10/1913 | Sprecher | 242/74 |
| 1,257,768 | 2/1918 | Turner et al. | 273/31 |
| 1,327,072 | 1/1920 | Thorward | 273/29 BB |
| 1,605,662 | 11/1926 | Kayser | 273/31 |
| 2,458,984 | 1/1949 | Engle | 273/31 X |
| 3,108,804 | 10/1963 | Wagner | 273/27 |
| 3,393,913 | 7/1968 | Safina | 273/31 X |
| 3,427,026 | 2/1969 | Mahoney | 273/26 A X |
| 3,938,806 | 2/1976 | Husbands | 273/29 B X |

FOREIGN PATENT DOCUMENTS

| | | | |
|---|---|---|---|
| 1,164,813 | 5/1958 | France | 242/74 |
| 5,861 of | 1902 | United Kingdom | 273/30 |
| 11,641 of | 1902 | United Kingdom | 273/30 |
| 13,182 of | 1902 | United Kingdom | 273/30 |
| 212,020 | 3/1924 | United Kingdom | 273/30 |
| 403,184 | 12/1933 | United Kingdom | 273/29 BB |

OTHER PUBLICATIONS

"The Sporting Goods Dealer"; Sep. 1973, p. 210.

*Primary Examiner*—Richard J. Apley

[57] ABSTRACT

A portable tennis court includes a net assembly consisting of two housings, wherein the net is contained on a reel assembly within one of the housing. The free end of the net assembly is affixed to a mounting rod contained in the other housing whereby the housings can be positioned thirty six feet away from each other. Each housing contains a pair of tape reels therein, wherein tapes are contained on each reel. The tapes are pulled outwardly from the housings to form the boundary lines of the tennis court. Elongated tapes are also provided to form the service lines, end lines, and service box divider line.

9 Claims, 3 Drawing Figures

PORTABLE TENNIS COURT

BACKGROUND OF THE INVENTION

U.S. Pat. No. 1,322,754 to Blair relates to a means for suspending tennis nets.

U.S. Pat. No. 1,327,072 to Thornward relates to an indoor ball game wherein person seated in chairs hit balls over a suspended net.

U.S. Pat No. 1,897,801 to Healy relates to tapes used in marking out a tennis court.

The aforementioned patents do not teach a net assembly which is retractable compact state as does my present invention.

SUMMARY OF THE INVENTION

My present invention relates to a unique and novel portable tennis court which can be readily assembled or disassembled into a tennis court.

An object of my present invention is to provide a net assembly which is capable of being stretched to a thirty six foot width or contracted into a compact storage state.

A further object of my present invention is to provide a plurality of tapes for forming the lines of the tennis court, wherein the tapes are retractable into the net assembly.

Another object of my present invention is to provide a means for anchoring the net assembly to the ground.

Briefly, my present invention comprises a net assembly consisting of two housings, wherein the net is contained on a reel assembly within one of the housing. The free end of the net assembly is affixed to a mounting rod contained in the order housing whereby the housings can be positioned thirty six feet away from each other. Each housing contains a pair of tape reels therein, wherein tapes are contained on each reel. The tapes are pulled outwardly from the housings to form the boundary lines of the tennis court. Elongated tapes are also provided to form the service lines, end lines, and service box divider line.

BRIEF DESCRIPTION OF THE DRAWINGS

The objects and features of the invention my be understood with reference to the following detailed description of an illustrative embodiment of the invention, taken together with the accompanying drawings in which.

DESCRIPTION OF THE PREFERRED EMBODIMENT

Figure 3:
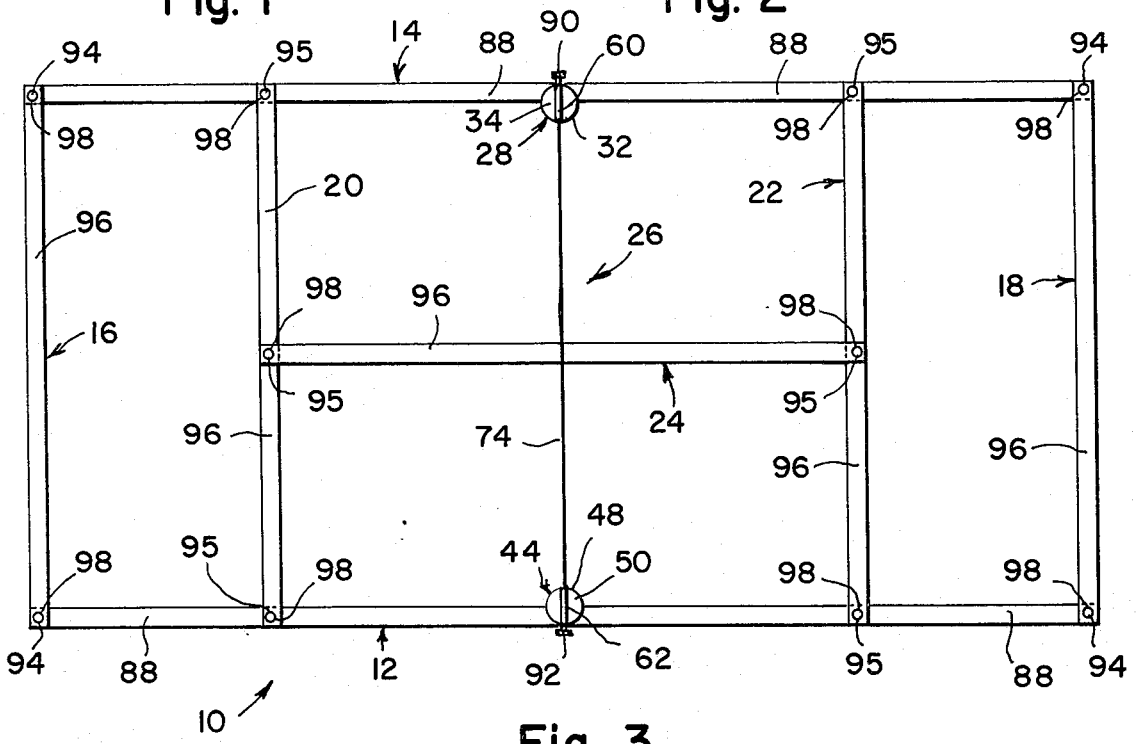
FIG. 3 illustrates a top view of the portable tennis court.

Turning now descriptively to the drawings, in which similar reference characters denote similar elements throughout the several views, FIG. 3 shows a portable tennis court 10 having a pair of boundary lines 12, 14, a pair of base lines 16, 18, a pair of service lines 20, 22 a service box divider line 24, and a net assembly 26.

Figure 1:
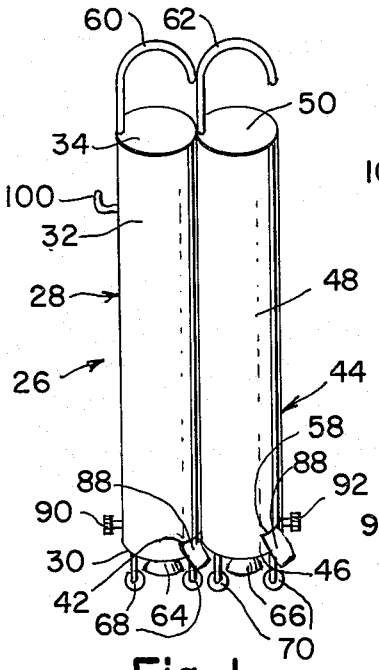
FIG. 1, illustrates a side perspective view of a net assembly of a portable tennis court.
Figure 2:
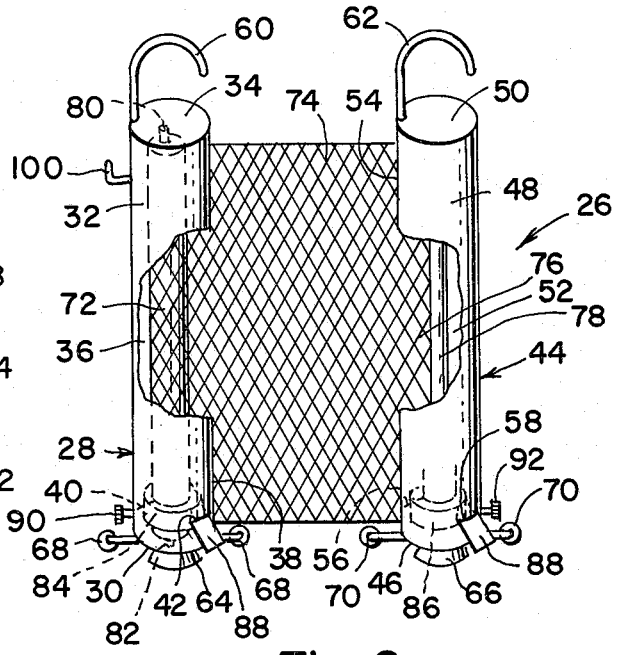
FIG. 2 illustrates a side partially cutaway view of the net assembly.

FIGS. 1–2 show the net assembly 26 which comprises a first cylindrically shaped housing 28 having a base 30, an upwardly extending cylindrically shaped sidewall 32, a top 34 and an interior chamber 36 therein. The sidewall 32 has an elongated longitudinal aperture 38 therethrough as well as a pair of transverse slot openings 40, 42 therethrough, wherein openings 40, 42 are disposed towards the base 30. A second cylindrically shaped housing 44 having a base 46, an upwardly extending cylindrically shaped sidewall 48, a top 50, and an interior chamber 52 therein. The sidewall 48 has an elongated longitudinal aperture 54 therethrough as well as a pair of transverse slot openings 56, 58 therethrough, wherein openings 56, 58 are disposed towards the base 46. One of two hooked shaped handles 60, 62 is affixed to the tops 34, 50 of each housing 28, 44. One of two flexible suction cups 64, 66 are affixed to the lower surfaces of the bases 30, 46 of each housing 28, 44 wherein cups 64, 66 are adapted to engage the ground. One of a pair of wheel members 68, 70 are pivotally affixed to the lower surfaces of the bases 30, 46 of each housing 28, 44. When wheel members 68, 70 extend downwardly, members 68, 70 are adapted to engage the ground such that cups 64, 66 are raised off of the ground. When members 68, 70 are flipped upwardly into a horizontal plane, cups 64, 66 are adapted to engage the gound. The wheel members 68, 70 are of a self locking construction thereby permitting each housing 28, 44 to be locked in position. A longitudinally placed spring loaded reel assembly 72 has a thirty six foot nylon net 74 associated therewith, wherein the free longitudinal edge 76 of net 74 extends through aperture 38 of sidewall 32, through aperture 54 of sidewall 48 into the chamber 52 of housing 44. A longitudinally place rod 78 extends between the base 46 and top 50 of housing 44 within chamber 52, wherein edge 76 of net 74 is affixed to rod 78. End pins 80, 82 are affixed to each end of the reel assembly 72, wherein one pin 80 is journalled for rotation in base 30 of housing 28 and the other pin 82 is journalled for rotation in top 34 of housing 28. Two tape reels 84, 86 are rotatably mounted in the lower end of each chamber 36, 52, wherein each reel 84, 86 has tapes 88 associated therewith, wherein the free ends of the tapes 88 extends outwardly through the openings 40, 42, 56, 58 of the two housings 28, 44. Two crank wheel handles 90, 92 are journalled for rotation through each sidewall 32, 48 of each housing 28, 44, wherein one of the crank wheel handles 90, 92 communicate with one of the tape reels 84, 86.

As shown in FIG. 3, each tape 88 has an end snap eyelet 94 therein as well as an intermediate snap eyelet 95. The four tapes 88 are pulled out from the housings 28, 44 so as to form the boundary lines 12, 14. A plurality of elongated tapes 96 are provided to form the base lines 16, 18, service lines 20, 22 and service box divider line 24, wherein the tapes 96 have end snaps 98 which engage eyelets 94, 95 of tapes 88. The tapes 96 for the service lines 20, 22 have intermediate eyelets 95 therein, wherein the end snaps 98 of the tape 96 for the service divider line 24 engages the intermediate eyelets 95 of the tapes 96 for the service lines 20, 22. The tapes 88, 96 are formed from a flexible rubber-like material or a plastic like material containing at least 10% fiberglass therein.

Referring back to FIG. 1, the tapes 88, 96 are rolled up for storage and hung on a hook member 100 which is mounted on the sidewall 32 of housing 28.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A portable tennis court, which comprises:

(a) a pair of cylindrically shaped housings, each said housing having a base, an upwardly extending cylindrically shaped sidewall, a top, and an interior chamber therein, each said sidewall having an elongated longitudinal aperture therethrough and a pair of slot openings therethrough;

(b) a pair of wheels mounted to each said base of each said housing, said wheels adapted to engage the ground;

(c) a reel assembly contained in one said housing;

(d) a mounting means contained in said chamber of said other housing;

(e) a net contained on said reel assembly, said net extending outwardly through said longitudinal aperture of said first housing, inwardly through said longitudinal aperture of said second housing, and affixed to said mounting means in said chamber of said other housing;

(f) means for anchoring each said housing to said ground;

(g) a pair of tape reels mounted for rotation in each said housing; and (h) an elongated tape associated with each said tape reel, said tapes extending through said slot openings of said housings.

2. A portable tennis court according to claim 1, wherein each said tape has an end snap eyelet and intermediate snap eyelet therein.

3. A portable tennis court according to claim 2 further including a plurality of elongated tapes having end snaps, said end snaps engaging said end snap eyelets of said tapes.

4. A portable tennis court according to claim 1, wherein said mounting means includes a longitudinally placed rod extending between said base and said top of one said housing, a free edge of said net extending through said longitudinal aperture of said one housing, and said free edge of said net affixed to said longitudinally placed rod.

5. A portable tennis court according to claim 1 wherein said means for anchoring comprises said pair of wheels pivotally mounted to each said housing, a suction cup affixed to said base of each housing, said suction cap adapted to engage said ground upon upward rotation of said wheels.

6. A portable tennis court according to claim 1, wherein each said top of each said housing has a hooked shaped handle affixed thereon.

7. A portable tennis court according to claim 1, wherein a crank handle is affixed to each said tape reel, each said crand handle journalled for rotation through said sidewalls of each said housing.

8. A portable tennis court according to claim 1, wherein said tape is formed from a flexible fiberglass plastic.

9. A portable tennis court according to claim 1, wherein said tape is formed from a flexible rubber.

* * * * *